US011337453B2

(12) United States Patent
Lipowicz et al.

(10) Patent No.: US 11,337,453 B2
(45) **Date of Patent: *May 24, 2022**

(54) LIQUID AEROSOL FORMULATION OF AN ELECTRONIC SMOKING ARTICLE

(71) Applicant: Altria Client Services LLC, Richmond, VA (US)

(72) Inventors: Peter Lipowicz, Midlothian, VA (US); Pauline Marcq, Richmond, VA (US); Gerd Kobal, Sandy Hook, VA (US); Munmaya K. Mishra, Manakin Sabot, VA (US); Georgios D. Karles, Richmond, VA (US); San Li, Midlothian, VA (US)

(73) Assignee: Altria Client Services LLC, Richmond, VA (US)

( * ) Notice: Subject to any disclaimer, the term of this patent is extended or adjusted under 35 U.S.C. 154(b) by 93 days.

This patent is subject to a terminal disclaimer.

(21) Appl. No.: 16/853,074

(22) Filed: Apr. 20, 2020

(65) Prior Publication Data

US 2020/0245678 A1 Aug. 6, 2020

Related U.S. Application Data

(62) Division of application No. 14/333,212, filed on Jul. 16, 2014, now Pat. No. 10,660,365.

(60) Provisional application No. 61/856,286, filed on Jul. 19, 2013.

(51) Int. Cl.

| | |
|---|---|
| ***A24F 47/00*** | (2020.01) |
| ***A24B 15/167*** | (2020.01) |
| ***A24F 40/20*** | (2020.01) |
| ***A24F 40/42*** | (2020.01) |
| ***A24F 40/48*** | (2020.01) |
| *A24F 40/10* | (2020.01) |

(52) U.S. Cl.

CPC ..... *A24B 15/167* (2016.11); *A24F 40/20* (2020.01); *A24F 40/42* (2020.01); *A24F 40/48* (2020.01); *A24F 40/10* (2020.01)

(58) Field of Classification Search

CPC ..... A24B 15/167; A24F 40/10

See application file for complete search history.

(56) References Cited

U.S. PATENT DOCUMENTS

| | | | |
|---|---|---|---|
| 4,612,942 | A | 9/1986 | Dobberstein et al. |
| 4,715,387 | A | 12/1987 | Rose |
| 5,133,368 | A | 7/1992 | Neumann et al. |

(Continued)

FOREIGN PATENT DOCUMENTS

| | | | |
|---|---|---|---|
| CN | 87107454 | A | 6/1988 |
| CN | 87108020 | A | 6/1988 |

(Continued)

OTHER PUBLICATIONS

International Search Report and Written Opinion dated Feb. 18, 2015.

(Continued)

*Primary Examiner* — Eric Yaary

(74) *Attorney, Agent, or Firm* — Harness, Dickey & Pierce, P.L.C.

(57) ABSTRACT

A liquid aerosol formulation for an electronic smoking article includes an aerosol former, water, nicotine, and an acid including tartaric acid. The acid is included in an amount sufficient to provide the liquid aerosol formulation with a pH ranging from about 4 to about 8.

15 Claims, 3 Drawing Sheets

(56) References Cited

U.S. PATENT DOCUMENTS

| | | | |
|---|---|---|---|
| 2002/0000225 | A1 | 1/2002 | Schuler et al. |
| 2002/0059939 | A1 | 5/2002 | Fox |
| 2006/0196518 | A1 | 9/2006 | Hon |
| 2008/0110454 | A1 | 5/2008 | White et al. |
| 2011/0226236 | A1 | 9/2011 | Buchberger |
| 2011/0303231 | A1 | 12/2011 | Li et al. |
| 2012/0255567 | A1 | 10/2012 | Rose et al. |
| 2013/0081623 | A1 | 4/2013 | Buchberger |
| 2014/0000638 | A1 | 1/2014 | Sebastian et al. |
| 2014/0060554 | A1 | 3/2014 | Collett et al. |
| 2014/0261474 | A1 | 9/2014 | Gonda |
| 2014/0345631 | A1 | 11/2014 | Bowen et al. |
| 2014/0345635 | A1 | 11/2014 | Rabinowitz et al. |
| 2015/0013695 | A1 | 1/2015 | McNeal et al. |
| 2015/0297580 | A1 | 10/2015 | Hearn et al. |
| 2016/0081395 | A1 | 3/2016 | Thorens et al. |

FOREIGN PATENT DOCUMENTS

| | | | |
|---|---|---|---|
| CN | 1541577 | A | 11/2004 |
| CN | 101583354 | A | 11/2009 |
| CN | 102014995 | A | 4/2011 |
| CN | 102612361 | A | 7/2012 |
| CN | 102655773 | A | 9/2012 |
| EP | 0 270 944 | A2 | 6/1988 |
| EP | 1618803 | A1 | 1/2006 |
| EP | 2319334 | A1 | 5/2011 |
| WO | WO-2006/004646 | A1 | 1/2006 |
| WO | WO-2007/078273 | A1 | 7/2007 |
| WO | WO-2011/006534 | A1 | 1/2011 |

OTHER PUBLICATIONS

Eurasian Notification for corresponding Application No. 201690249 dated Nov. 16, 2017.

Chinese Office Action dated Jan. 24, 2018 for corresponding Chinese Patent Application No. 201480050829.0.

Eurasian Notification dated Apr. 24, 2018 for corresponding Eurasian Application No. 201690249.

European Examination Report dated Aug. 10, 2018 for corresponding European Application No. 14745331.0.

Chinese Office Action dated Aug. 16, 2018 for corresponding Chinese Application No. 201480050829.0.

Office Action dated Nov. 6, 2018 from the Ukraine Patent Office for Ukraine Appl. No. a201601551 (PCT/US2014/046903).

Official Notification issued by the Eurasian Patent Office dated Dec. 27, 2018 for Eurasian Appl. No. 201690249.

Substantive Examination Adverse Report (Section 30(1)) from the Intellectual Property Corporation of Malaysia dated Feb. 25, 2019.

Notification of Defects in Patent Application No. 243679 from the Israeli Patent Office dated Feb. 18, 2019.

Chinese Office Action dated Mar. 29, 2019 in corresponding Chinese Patent Application No. 201480050829.0.

Thomas A. Perfetti, Structural Study of Nicotine Salts, Beitrate Zure Tabaliforschung International, vol. 12, No. 2, Jun. 1983.

Eurasian Notification of patent grant dated Jun. 28, 2019, issued in corresponding Eurasian Patent Application No. 201690249.

Ukrainian Office Action dated Dec. 3, 2019, issued in corresponding Ukrainian Patent Application No. a201601551.

European Examination Report dated Feb. 28, 2020, issued in corresponding European Application No. 14745331.0.

'Succinic acid' *Genetika Research Center*, 2015 http://eng.genetika.ru/science/succinic-acid/.

Office Action dated May 25, 2020, issued in corresponding Israeli Patent Application No. 243679.

Office Action dated Jun. 9, 2021, issued in corresponding Chinese Patent Application No. 201910633386.2.

European Examination Communication dated Feb. 17, 2021, issued in corresponding European Application No. 14745331.0.

Chinese Office Action dated Mar. 22, 2022, issued in corresponding Chinese Patent Application No. 201910633386.2.

LIQUID AEROSOL FORMULATION OF AN ELECTRONIC SMOKING ARTICLE

CROSS-REFERENCE TO RELATED APPLICATIONS

This application is a divisional of U.S. application Ser. No. 14/333,212, filed Jul. 16, 2014, which claims priority under 35 U.S.C. § 119(e) to U.S. provisional Application No. 61/856,286, filed on Jul. 19, 2013, the entire contents of each of which are incorporated herein by reference thereto.

BACKGROUND

A lit-end smoking article produces an aerosol known to create pleasant sensory experience for adult smokers, including a low to moderate harshness response in the throat and a perceived warmth in the chest. The preferred levels of harshness in the throat and perceived warmth in the chest will differ amongst adult cigarette smokers.

OBJECT OF THE PREFERRED EMBODIMENTS

An object of the teachings herein is the achievement of an electronic smoking article, such as an electronic cigarette, which is capable of providing a pleasant sensory experience for adult smokers that is similar to those enjoyed by them while smoking a lit end cigarette.

Another object of the teachings herein is the achievement of an electronic smoking article which is capable of providing a sensory experience comprising levels of harshness in the throat and perceived warmth in the chest that are similar to those experienced by adult smokers when smoking a lit end cigarette.

SUMMARY OF SELECTED FEATURES

In an embodiment, a liquid aerosol formulation operative in an electronic smoking article having a heater operating temperature is provided. The liquid aerosol formulation comprises an aerosol former, water in an amount of 0% to about 40% by weight based on the weight of the liquid aerosol formulation, nicotine in an amount of at least about 2% by weight based on the weight of the liquid aerosol formulation, and an acid having a melting point and/or a boiling point of at least about 150° C. and such that the acid volatilizes at the heater temperature and is condensable at ambient temperatures. The acid is included in an amount sufficient to provide the liquid aerosol formulation with a pH ranging from about 4 to about 8. The liquid aerosol formulation forms an aerosol having a particulate phase and a gas phase when heated during operation of the electronic smoking article. The particulate phase contains protonated nicotine and the gas phase contains unprotonated nicotine. The gas phase nicotine content of the aerosol is less than about 1% of a total nicotine content of the aerosol.

The liquid aerosol formulation can also comprise at least one flavorant in an amount ranging from about 0.2% to about 15% by weight. Moreover, the aerosol former is selected from the group consisting of propylene glycol, glycerin and combinations thereof. The aerosol former is included in an amount ranging from about 40% by weight to about 90% by weight. The acid preferably has a boiling point ranging from about 150° C. to about 250° C. or the acid preferably has a melting point ranging from about 150° C. to about 250° C. In an embodiment, the acid has a melting point and/or a boiling point of about 150° C. to about 300° C. In a preferred embodiment, the liquid formulation comprises glycerin and propylene glycol in a ratio of about 2:3 or greater. Moreover, nicotine is included in an amount ranging from about 2% by weight to about 10% by weight. The particulate phase comprises particles ranging in size from about 0.2 micron to about 2 microns. The acid is included in an amount ranging from about 0.1% by weight to about 15% by weight. The water can be included in an amount of about 5% by weight to about 40% by weight based on the weight of the liquid aerosol formulation or in an amount of about 5% to about 15% by weight based on the weight of the liquid aerosol formulation. In an embodiment, the liquid aerosol formulation has a pH ranging from about 5.5 to about 8.

In an embodiment, the liquid aerosol formulation also comprises ammonia or an ammonia containing compound in an amount sufficient to reduce the pH of the liquid aerosol formulation by about 1 to about 2 pH units.

The acid is selected from the group consisting of succinic acid, tartaric acid, sulfuric acid, carbonic acid, malonic acid, tartronic acid, levulinic acid, acetic acid, benzoic acid, adipic acid, gluaric acid, pimelic acid combinations thereof. In a preferred embodiment, the acid comprises tartaric acid. In another preferred embodiment, at least some of the acid and at least some of the nicotine is from a nicotine-acid salt. Also preferably, the nicotine-acid salt comprises nicotine bitartrate.

In another embodiment, an electronic smoking article operable to produce an aerosol which substantially replicates a sensory experience of smoking a lit-end cigarette is provided. The electronic smoking article comprises a heater, and a liquid aerosol formulation. The heater is operable to volatilize the liquid aerosol formulation and form an aerosol. The liquid aerosol formulation comprises an aerosol former, water in an amount of 0% by weight to about 40% by weight based on the weight of the liquid aerosol formulation, nicotine in an amount of at least about 2% by weight based on the weight of the liquid aerosol formulation, and an acid in an amount sufficient to provide the liquid aerosol formulation with a pH ranging from about 4 to about 8. The liquid aerosol formulation is capable of forming the aerosol having a particulate phase and a gas phase when heated by the heater. The particulate phase contains protonated nicotine and the gas phase contains unprotonated nicotine. The aerosol has a majority amount of the protonated nicotine and a minority amount of the unprotonated nicotine. The sensory experience includes a perception of chest warmth and moderate throat harshness during a puff.

In an embodiment, the heater comprises a capillary tube in fluid communication with a reservoir containing the liquid aerosol formulation. The reservoir is pressurized and comprises a mechanically or electrically operated valve at an outlet of the reservoir. The reservoir is compressible such that the liquid material is manually pumped to the capillary.

In an embodiment, the heater is a coil heater in communication with a filamentary wick which draws liquid from a reservoir via capillary action. The electronic smoking article further comprises an outer tube extending in a longitudinal direction, an inner tube within the outer tube, and the reservoir comprising an outer annulus between the outer tube and the inner tube. The coil heater is located in the inner tube and the filamentary wick is in communication with the reservoir and surrounded by the coil heater such that the wick delivers the liquid aerosol formulation to the coil heater and the coil heater heats the liquid aerosol formulation to a temperature sufficient to vaporize the liquid aerosol formulation and form the aerosol.

In an embodiment, a method of replicating a sensory experience of smoking a lit-end cigarette comprises heating a liquid aerosol formulation to form an aerosol. The liquid aerosol formulation comprises an aerosol former, water in an amount of 0% by weight to about 40% by weight based on the weight of the liquid aerosol formulation, nicotine in an amount of about 2% or more by weight based on the weight of the liquid aerosol formulation, and an acid in an amount sufficient to provide the liquid aerosol formulation with a pH ranging from about 4 to about 8. The aerosol has a particulate phase and a gas phase. The particulate phase contains protonated nicotine and the gas phase contains unprotonated nicotine. The unprotonated nicotine is preferably less than about 1% of a total nicotine content of the aerosol. The sensory experience includes a perception of chest warmth and moderate throat harshness during a puff. Moreover, the acid has a melting point and/or a boiling point of at least about 150° C. such that the acid volatilizes at a heater temperature and is condensable at ambient temperatures.

In another embodiment, a method of forming an aerosol with an electronic smoking article comprises heating a liquid aerosol formulation to a temperature sufficient to form an aerosol. The liquid aerosol formulation comprises an aerosol former, water in an amount of 0% by weight to about 40% by weight based on the weight of the liquid aerosol formulation, nicotine in an amount of at least about 2% by weight based on the weight of the liquid aerosol formulation, and an acid in an amount sufficient to provide the liquid aerosol formulation a pH ranging from about 4 to about 8. The acid is operative upon the aerosol so as to reduce an amount of perceived throat harshness by a smoker in comparison to the aerosol being formed upon operation of the electronic smoking article without the acid.

In an embodiment, the acid comprises tartaric acid in an amount ranging from about 0.1% by weight to about 15% by weight based on the weight of the liquid aerosol formulation. Moreover, the liquid aerosol formulation can further comprise ammonia or an ammonia containing compound in an amount sufficient to reduce the pH of the final liquid aerosol formulation by about 1 to about 2 pH units.

In yet another embodiment, a method of forming a component of an electronic smoking article comprises preparing a liquid aerosol formulation by combining an aerosol former in an amount of at least about 50% by weight based on the weight of the liquid aerosol formulation and water in an amount of about 5% by weight to about 40% by weight based on the weight of the liquid aerosol formulation, adding nicotine bitartrate in an amount sufficient to establish a nicotine content of at least about 2% by weight to the liquid aerosol formulation, and filling a reservoir of a component of an electronic smoking article with the liquid aerosol formulation.

In another embodiment, an aerosol is produced by heating a liquid aerosol formulation in an electronic smoking article. The liquid aerosol formulation comprises nicotine in an amount of at least about 2% by weight based on the weight of the liquid aerosol formulation and an acid. The nicotine content is sufficient to produce a perception of chest warmth associated with smoking a lit end cigarette. The aerosol has a gas phase nicotine content of the aerosol of less than 1% of a total nicotine content of the aerosol. The acid is operative upon the aerosol so as to reduce an amount of perceived throat harshness by a smoker in comparison to the aerosol being formed upon operation of the electronic smoking article without the acid.

DETAILED DESCRIPTION

In an embodiment, an electronic smoking article comprises a liquid supply (reservoir) containing a liquid aerosol formulation. The liquid aerosol formulation is delivered to a heater where the liquid aerosol formulation is heated and volatilized. As used herein, the term "electronic smoking article" is inclusive of all types of electronic smoking articles, regardless of form, size or shape, including electronic cigarettes, electronic cigars, electronic pipes, electronic hookahs and the like. Moreover, the liquid aerosol formulation can include tobacco flavors or instead, or in combination, include other suitable flavors.

In a preferred embodiment, the liquid aerosol formulation includes (comprises) an acid (as used herein "an acid" means one or more acids), which protonates nearly all of the molecular nicotine in the liquid formulation, so that upon heating of the liquid aerosol formulation in the electronic smoking article, an aerosol having a majority amount of protonated nicotine and a minority amount of unprotonated nicotine is produced, whereby only a minor portion of all the volatilized (vaporized) nicotine remains in the gas phase of the aerosol.

Preferably, the aerosol produced from the liquid aerosol formulation includes unprotonated nicotine in an amount ranging from about 0.1% to about 1.0% by weight based on the total nicotine content in the aerosol, more preferably about 0.1% to 0.5% by weight based on the total nicotine content in the aerosol. Since the majority of the nicotine in the aerosol is protonated, the aerosol contributes a sensory response of low to mild harshness in the throat, even at elevated nicotine levels in the liquid aerosol formulation. Much of the foregoing occurs, because protonated nicotine is charged and does not enter or remain in a gas phase of the aerosol, but is instead found in a particulate phase of the aerosol.

Preferably, the acid: (a) is sufficiently, thermally stable to withstand a heating cycle of an electronic smoking article so that at least a substantial portion of the acid enters the gas vapor phase as an acid; (b) volatilizes at the heater temperature; and (c) is condensable at ambient temperatures. In a preferred embodiment, the acid has a melting point and/or a boiling point of at least about 150° C. and is included in the liquid aerosol formulation in an amount sufficient to adjust the pH of the liquid aerosol formulation to about 4 to about 8, more preferably about 5.5 to about 8.

Figure 1:
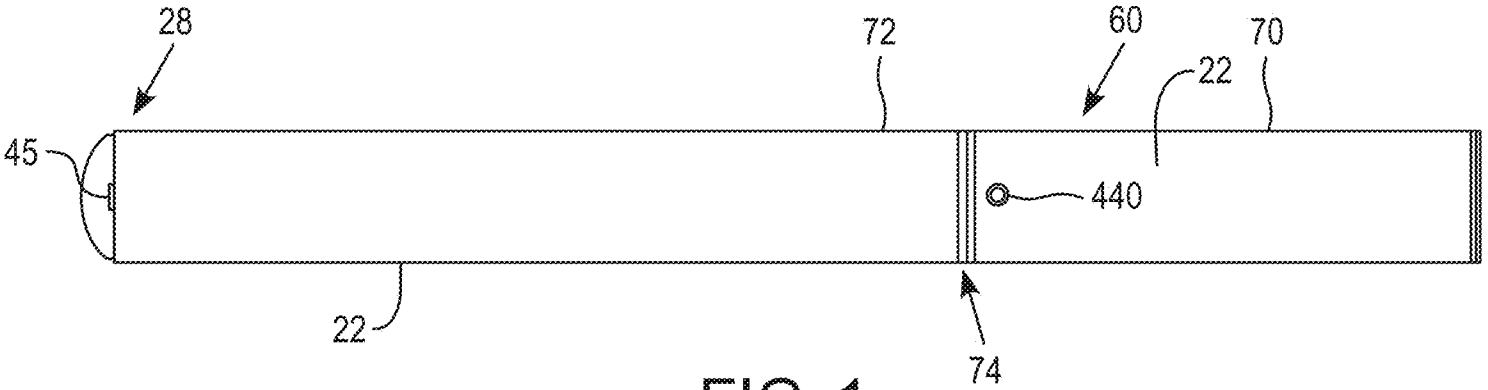
FIG. 1 is a side view of an electronic smoking article constructed according to an embodiment.

The liquid aerosol formulation disclosed herein forms an aerosol when vaporized in an electronic smoking article as shown in FIG. 1. The electronic smoking article 60 comprises a replaceable cartridge (or first section) 70 and a reusable fixture (or second section) 72, which are coupled together at a threaded joint 74 or by other convenience such as a snug-fit, snap-fit, detent, clamp and/or clasp.

Figure 3:
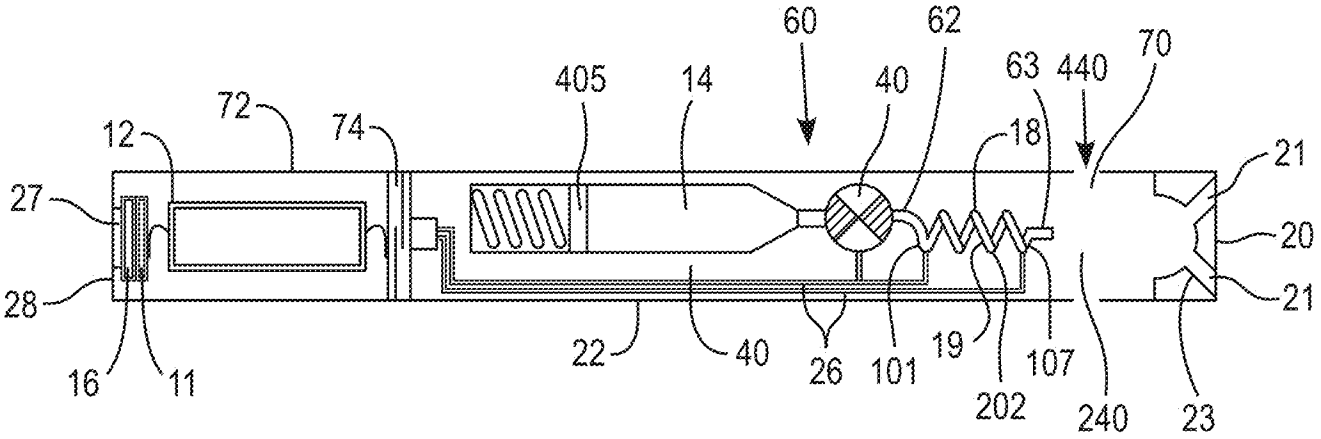
FIG. 3 is a cross-sectional view of another embodiment of an electronic smoking article according to an embodiment.

As shown in FIG. 3, the first section 70 can house a mouth end insert 20, a capillary aerosol generator including a capillary (capillary tube) 18, a heater 19 to heat at least a portion of the capillary 18, a reservoir 14 and optionally a valve 40. Alternatively, as shown in FIG. 4, the first section 70 can house a mouth end insert 20, a heater 319, a flexible, filamentary wick 328 and a reservoir 314 as discussed in further detail below.

Figure 4:
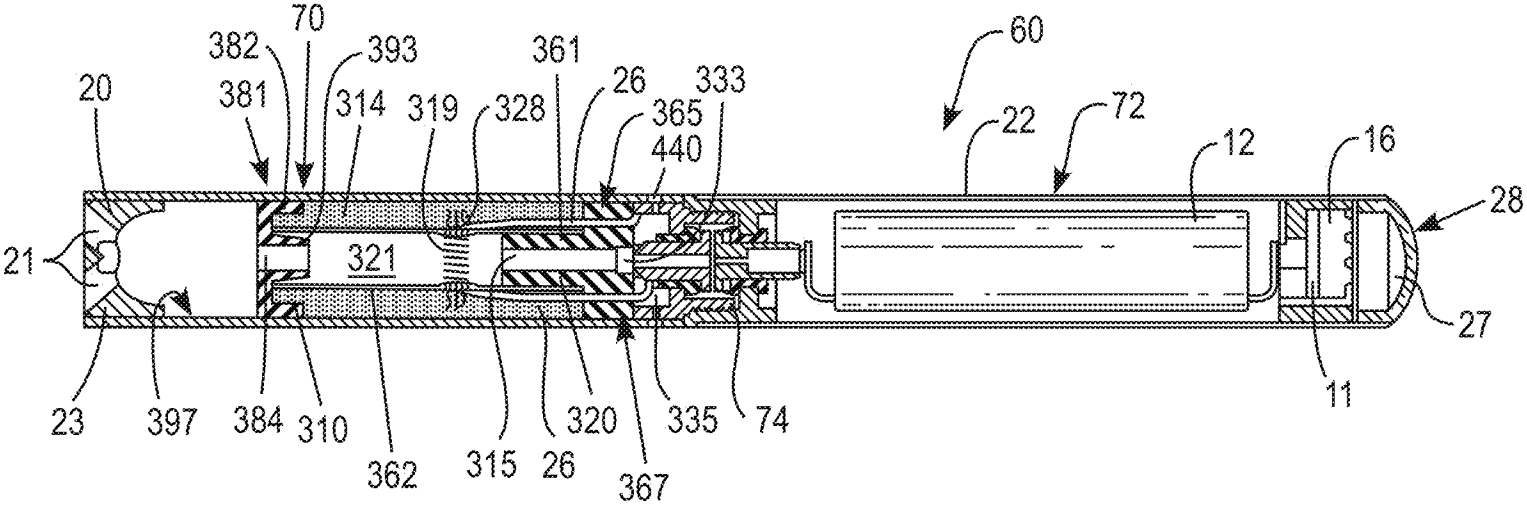
FIG. 4 is a cross-sectional view of an electronic smoking article according to an embodiment.

The second section 72 can house a power supply 12 (shown in FIGS. 2, 3 and 4), control circuitry 11, and optionally a puff sensor 16 (shown in FIGS. 3 and 4). The threaded portion 74 of the second section 72 can be connected to a battery charger when not connected to the first section 70 for use so as to charge the battery.

Figure 2:
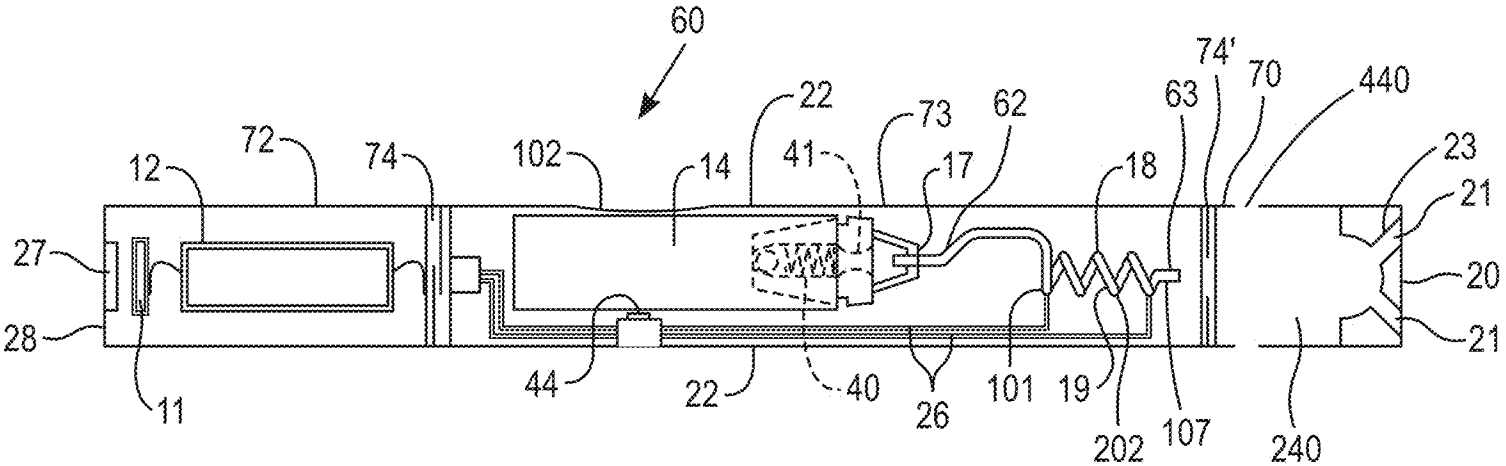
FIG. 2 is a cross-sectional view of an electronic smoking article according to an embodiment.

As shown in FIG. 2, the electronic smoking article 60 can also include a middle section (third section) 73, which can house the reservoir 14, the heater 19, and the valve 40. The middle section 73 can be adapted to be fitted with a threaded joint 74' at an upstream end of the first section 70 and a threaded joint 74 at a downstream end of the second section 72. In this embodiment, the first section 70 houses the mouth end insert 20, while the second section 72 houses the power supply 12 and control circuitry.

Preferably, the first section 70, the second section 72 and the optional third section 73 include an outer cylindrical housing 22 extending in a longitudinal direction along the length of the electronic smoking article 60. Moreover, in one embodiment, the middle section 73 is disposable and the first section 70 and/or second section 72 are reusable. In another embodiment, the first section 70 can also be replaceable so as to avoid the need for cleaning the capillary 18 and/or heater 19. The sections 70, 72, 73 can be attached by threaded connections whereby the middle section 73 can be replaced when the liquid aerosol formulation in the reservoir 14 is used up.

It is contemplated that the first section 70 and the second section 72 may be unitary and without threaded connections.

As shown in FIG. 2, the outer cylindrical housing 22 can include a cutout or depression 102 which allows a smoker to manually apply pressure to the reservoir 14. Preferably, the outer cylindrical housing 22 is flexible and/or compressible along the length thereof and fully or partially covers the reservoir 14. The cutout or depression 102 can extend partially about the circumference of the outer cylindrical housing 22. Moreover, the reservoir 14 is compressible such that when pressure is applied to the reservoir, liquid is pumped from the reservoir 14 to the capillary 18. A pressure activated switch 44 can be positioned beneath the reservoir 14. When pressure is applied to the reservoir 14 to pump liquid, the switch is also pressed and a heater 19 is activated. The heater 19 can be a portion of the capillary 18. By applying manual pressure to the pressure switch, the power supply 12 is activated and an electric current heats the liquid in the capillary 18 via electrical contacts so as to volatilize the liquid.

In the embodiment of FIG. 2, the reservoir 14 is a tubular, elongate body formed of an elastomeric material so as to be flexible and/or compressible when squeezed. Preferably, the elastomeric material can be selected from the group consisting of silicone, plastic, rubber, latex, and combinations thereof.

Preferably, the compressible reservoir 14 has an outlet 17 which is in fluid communication with a capillary 18 so that when squeezed, the reservoir 14 can deliver a volume of liquid material to the capillary 18. Simultaneous to delivering liquid to the capillary, the power supply 12 is activated upon application of manual pressure to the pressure switch and the capillary 18 is heated to form a heated section wherein the liquid material is volatilized. Upon discharge from the heated capillary 18, the volatilized material expands, mixes with air and forms an aerosol.

Preferably, the reservoir 14 extends longitudinally within the outer cylindrical housing 22 of the first section 70 (shown in FIGS. 3 and 4) or the middle section 73 (shown in FIG. 2). Moreover, the reservoir 14 comprises a liquid aerosol formulation which is volatilized when heated and forms an aerosol when discharged from the capillary 18.

In the embodiments shown in FIGS. 2 and 3, the capillary 18 includes an inlet end 62 in fluid communication with the outlet 17 of the reservoir 14, and an outlet end 63 operable to expel volatilized liquid material from the capillary 18. In a preferred embodiment, as shown in FIGS. 2 and 3, the reservoir 14 may include the valve 40.

As shown in FIG. 2, the valve 40 can be a check valve that is operable to maintain the liquid material within the reservoir, but opens when the reservoir 14 is squeezed and pressure is applied. Preferably, the check valve 40 opens when a critical, minimum pressure is reached so as to avoid inadvertent dispensing of liquid material from the reservoir 14 or activating the heater 19. Preferably, the critical pressure needed to open the check valve 40 is essentially equal to or slightly less than the pressure required to press a pressure switch 44 to activate the heater 19. Preferably, the pressure required to press the pressure switch 44 is high enough such that accidental heating is avoided. Such arrangement avoids activation of the heater 19 in the absence of liquid being pumped through the capillary.

Advantageously, the use of a check valve 40 aids in limiting the amount of liquid that is drawn back from the capillary upon release of pressure upon the reservoir 14 (and/or the switch 44) if manually pumped so as to avoid air uptake into the reservoir 14. Presence of air degrades pumping performance of the reservoir 14.

Once pressure upon the reservoir 14 is relieved, the valve 40 closes. The heated capillary 18 discharges liquid remaining downstream of the valve 40.

Optionally, a critical flow orifice 41 is located downstream of the check valve 40 to establish a maximum flow rate of liquid to the capillary 18.

As shown in FIG. 3, in other embodiments, the valve 40 can be a two-way valve and the reservoir 14 can be pressurized. For example, the reservoir 14 can be pressurized using a pressurization arrangement 405 which applies constant pressure to the reservoir 14. For example, pressure can be applied to the reservoir 14 using an internal or external spring and plate arrangement which constantly applies pressure to the reservoir 14. Alternatively, the reservoir 14 can be compressible and positioned between two plates that are connected by springs or the reservoir 14 could be compressible and positioned between the outer housing and a plate that are connected by a spring so that the plate applies pressure to the reservoir 14.

Preferably, the capillary 18 of FIGS. 2 and 3 has an internal diameter of 0.01 to 10 mm, preferably 0.05 to 1 mm, and more preferably 0.05 to 0.4 mm. Capillaries of smaller diameter provide more efficient heat transfer to the fluid because, with the shorter distance to the center of the fluid, less energy and time is required to vaporize the liquid.

Also preferably, the capillary 18 may have a length of about 5 mm to about 72 mm, more preferably about 10 mm to about 60 mm or about 20 mm to about 50 mm. In one embodiment, the capillary 18 is substantially straight. In other embodiments, the capillary 18 is coiled and/or includes one or more bends therein to conserve space and/or accommodate a long capillary.

In these embodiments, the capillary 18 is formed of a conductive material, and thus acts as its own heater 19 by passing current through the capillary. The capillary 18 may be any electrically conductive material capable of being resistively heated, while retaining the necessary structural integrity at the operating temperatures experienced by the capillary 18, and which is non-reactive with the liquid material. Suitable materials for forming the capillary 18 are selected from the group consisting of stainless steel, copper, copper alloys, porous ceramic materials coated with film resistive material, Inconel® available from Special Metals Corporation, which is a nickel-chromium alloy, nichrome, which is also a nickel-chromium alloy, and combinations thereof.

In one embodiment, the capillary 18 is a stainless steel capillary 18, which serves as a heater 19 via electrical leads 26 attached thereto for passage of direct or alternating current along a length of the capillary 18. Thus, the stainless steel capillary 18 is heated by resistance heating. The stainless steel capillary 18 is preferably circular in cross section and may be formed of tubing suitable for use as a hypodermic needle of various gauges. For example, the capillary 18 may comprise a 32 gauge needle has an internal diameter of 0.11 mm and a 26 gauge needle has an internal diameter of 0.26 mm.

In another embodiment, the capillary 18 may be a non-metallic tube such as, for example, a glass tube. In such an embodiment, the heater 19 is formed of a conductive material capable of being resistively heated, such as, for example, stainless steel, nichrome or platinum wire, arranged along the glass tube. When the heater arranged along the glass tube is heated, liquid material in the capillary 18 is heated to a temperature sufficient to at least partially volatilize liquid material in the capillary 18.

Preferably, at least two electrical leads 26 are bonded to a metallic capillary 18. In the preferred embodiment, the at least two electrical leads 26 are brazed to the capillary 18. Preferably, one electrical lead 26 is brazed to a first, upstream portion 101 of the capillary 18 and a second electrical lead 26 is brazed to a downstream, end portion 107 of the capillary 18, as shown in FIGS. 2 and 3.

In use, once the capillary 18 of FIGS. 2 and 3 is heated, the liquid material contained within a heated portion of the capillary 18 is volatilized and ejected out of the outlet 63 where it expands and mixes with air and forms an aerosol in a mixing chamber 240.

As noted above, the liquid aerosol formulation can also be used in an electronic smoking article including a heater 319 and a filamentary wick 328 as shown in FIG. 4. The first section 70 includes an outer tube (or casing) 22 extending in a longitudinal direction and an inner tube (or chimney) 362 coaxially positioned within the outer tube 22. Preferably, a nose portion 361 of an upstream gasket (or seal) 320 is fitted into an upstream end portion 365 of the inner tube 362, while at the same time, an outer perimeter 367 of the gasket 320 provides a liquid-tight seal with an interior surface 397 of the outer casing 22. The upstream gasket 320 also includes a central, longitudinal air passage 315, which opens into an interior of the inner tube 362 that defines a central channel 321. A transverse channel 333 at an upstream portion of the gasket 320 intersects and communicates with the central, longitudinal air passage 315 of the gasket 320. This channel 333 assures communication between the central, longitudinal air passage 315 and a space 335 defined between the gasket 320 and a threaded connection 74.

Preferably, a nose portion 393 of a downstream gasket 310 is fitted into a downstream end portion 381 of the inner tube 362. An outer perimeter 382 of the gasket 310 provides a substantially liquid-tight seal with the interior surface 397 of the outer casing 22. The downstream gasket 310 includes a central channel 384 disposed between the central passage 321 of the inner tube 362 and the mouth end insert 20.

In this embodiment, the reservoir 314 is contained in an annulus between the inner tube 362 and the outer casing 22 and between the upstream gasket 320 and the downstream gasket 310. Thus, the reservoir 314 at least partially surrounds the central air passage 321. The reservoir 314 comprises a liquid material and optionally a liquid storage medium (not shown) operable to store the liquid material therein.

The inner tube 362 has the central air passage 321 extending therethrough which houses the heater 319. The heater 319 is in contact with the filamentary wick 328, which preferably extends between opposing sections of the reservoir 314 so as to deliver the liquid aerosol formulation from the reservoir 314 to the heater 319.

Preferably, the electronic smoking article 60 of each embodiment described herein also includes at least one air inlet 440. As shown in FIG. 4, the at least one air inlet 440 can be located upstream of the heater 319.

In the embodiments shown in FIGS. 2 and 3, the at least one air inlet 440 is preferably arranged downstream of the capillary 18 so as to minimize drawing air along the capillary and thereby avoid cooling of the capillary 18 during heating cycles.

In the embodiments, the at least one air inlet 440 includes one or two air inlets. Alternatively, there may be three, four, five or more air inlets. Altering the size and number of air inlets 440 can also aid in establishing the resistance to draw of the electronic smoking article 60.

The power supply 12 of each embodiment can include a battery arranged in the electronic smoking article 60. The power supply 12 is operable to apply voltage across the heater 19 associated with the capillary 18, as shown in FIGS. 2 and 3, or the heater 319 associated with the filamentary wick 328, as shown in FIG. 4. Thus, the heater 19, 319 volatilizes liquid material according to a power cycle of either a predetermined time period, such as a 2 to 10 second period.

Preferably, the electrical contacts or connection between the heater 19, 319 and the electrical leads 26 are highly conductive and temperature resistant while the heater 19, 319 is highly resistive so that heat generation occurs primarily along the heater 19 and not at the contacts.

The battery can be a Lithium-ion battery or one of its variants, for example a Lithium-ion polymer battery. Alternatively, the battery may be a Nickel-metal hydride battery, a Nickel cadmium battery, a Lithium-manganese battery, a Lithium-cobalt battery or a fuel cell. In that case, preferably, the electronic smoking article 60 is usable by a smoker until the energy in the power supply is depleted. Alternatively, the power supply 12 may be rechargeable and include circuitry allowing the battery to be chargeable by an external charging device. In that case, preferably the circuitry, when charged, provides power for a pre-determined number of puffs, after which the circuitry must be re-connected to an external charging device.

Preferably, the electronic smoking article 60 of each embodiment also includes control circuitry 11 (shown in FIGS. 2, 3 and 4), which can be on a printed circuit board. The control circuitry 11 can also include a heater activation light 27 that is operable to glow when the heater 19, 319 is activated. Preferably, the heater activation light 27 comprises at least one LED and is at an upstream end 28 (shown in FIG. 1) of the electronic smoking article 60 so that the heater activation light 27 illuminates a cap which takes on the appearance of a burning coal during a puff. Moreover, the heater activation light 27 can be arranged to be visible to the smoker. In addition, the heater activation light 27 can be utilized for smoking article system diagnostics. The light 27 can also be configured such that the smoker can activate and/or deactivate the light 27 when desired, such that the light 27 would not activate during smoking if desired.

The time-period of the electric current supply to the heater 19 may be pre-set depending on the amount of liquid desired to be vaporized. The control circuitry 11 can be programmable and can include an application specific integrated circuit (ASIC). In other embodiments, the control circuitry 11 can include a microprocessor programmed to carry out functions such as heating the capillaries and/or operating the valves.

As shown in FIGS. 2, 3 and 4 the electronic smoking article 60 further includes the mouth end insert 20 having at least two off-axis, preferably diverging outlets 21. Preferably, the mouth end insert 20 includes at least two diverging outlets 21. (e.g. 3, 4, 5, or preferably 6 to 8 outlets or more). Preferably, the outlets 21 of the mouth end insert 20 are located at ends of off-axis passages 23 and are angled outwardly in relation to the longitudinal direction of the electronic smoking article 60 (i.e., divergently). As used herein, the term "off-axis" denotes at an angle to the longitudinal direction of the electronic smoking article. Also preferably, the mouth end insert (or flow guide) 20 includes outlets uniformly distributed around the mouth end insert 20 so as to substantially uniformly distribute aerosol in a smoker's mouth during use. Thus, as the aerosol passes into a smoker's mouth, the aerosol enters the mouth and moves in different directions so as to provide a full mouth feel as compared to electronic smoking articles having an on-axis single orifice which directs the aerosol to a single location in a smoker's mouth.

In addition, the outlets 21 and off-axis passages 23 are arranged such that droplets of unaerosolized liquid material carried in the aerosol impact interior surfaces of the mouth end insert 20 and/or interior surfaces of the off-axis passages 23 such that the droplets are removed or broken apart. In the preferred embodiment, the outlets 21 of the mouth end insert 20 are located at the ends of the off-axis passages 23 and are angled at 5 to 60° with respect to the central longitudinal axis of the electronic smoking article 60 so as to more completely distribute aerosol throughout a mouth of a smoker during use and to remove droplets.

Preferably, each outlet 21 has a diameter of about 0.015 inch to about 0.090 inch (e.g., about 0.020 inch to about 0.040 inch or about 0.028 inch to about 0.038 inch). The size of the outlets 21 and off-axis passages 23 along with the number of outlets 21 can be selected to adjust the resistance to draw (RTD) of the electronic smoking article 60, if desired.

Preferably, the electronic smoking article 60 is about the same size as a conventional smoking article. In some embodiments, the electronic smoking article 60 can be about 80 mm to about 110 mm long, preferably about 80 mm to about 100 mm long and about 7 mm to about 8 mm in diameter. For example, in an embodiment, the electronic smoking article is about 84 mm long and has a diameter of about 7.8 mm.

The outer cylindrical housing 22 of the electronic smoking article 60 may be formed of any suitable material or combination of materials. Preferably, the outer cylindrical housing 22 is formed at least partially of metal and is part of the electrical circuit.

In the embodiment shown in FIG. 2, at least a portion of the outer cylindrical housing 22 can be elastomeric so as to allow a smoker to squeeze the housing 22 and the reservoir 14 during smoking to release liquid material therefrom and activate the heater 19. Thus, the outer cylindrical housing 22 can be formed of a variety of materials including plastics, rubber and combinations thereof. In an embodiment, the outer cylindrical housing 22 is formed of silicone. The outer cylindrical housing 22 can be any suitable color and/or can include graphics or other indicia printed thereon.

Preferably, the liquid aerosol formulation for use in each of the electronic smoking articles 60 described herein includes at least one aerosol former, water, a nicotine source, and at least one acid.

In the preferred embodiment, the at least one aerosol former is selected from the group consisting of propylene glycol, glycerin and combinations thereof. Preferably, the at least one aerosol former is included in an amount ranging from about 40% by weight based on the weight of the liquid formulation to about 90% by weight based on the weight of the liquid formulation (e.g., about 50% to about 80%, about 55% to about 75% or about 60% to about 70%). Moreover, in one embodiment, the liquid formulation can include propylene glycol and glycerin included in a weight ratio of about 3:2.

Preferably, the liquid formulation also includes water. Water can be included in an amount ranging from about 5% by weight based on the weight of the liquid formulation to about 40% by weight based on the weight of the liquid formulation, more preferably in an amount ranging from about 10% by weight based on the weight of the liquid formulation to about 15% by weight based on the weight of the liquid formulation.

The liquid aerosol formulation optionally includes at least one flavorant in an amount ranging from about 0.2% to about 15% by weight (e.g., about 1% to about 12%, about 2% to about 10%, or about 5% to about 8%). The at least one flavorant can be a natural flavorant or an artificial flavorant. Preferably, the at least one flavorant is selected from the group consisting of tobacco flavor, menthol, wintergreen, peppermint, herb flavors, fruit flavors, nut flavors, liquor flavors, and combinations thereof.

Also preferably, the liquid aerosol formulation includes an acid having a melting point and/or a boiling point of at least about 150° C. For example, the acid can have a melting point and/or a boiling point ranging from about 150° C. to about 300° C., more preferably about 150° C. to about 250° C. (e.g., about 160° C. to about 240° C., about 170° C. to about 230° C., about 180° C. to about 220° C. or about 190° C. to about 210° C.). By including an acid having a melting point and/or a boiling point within this range, the acid may volatilize when heated by heater elements of electronic smoking articles as previously described. In an embodiment utilizing a heater coil and a wick, the heater coil may reach an operating temperature at or about 300° C.

Also preferably, the acid is included in the liquid aerosol formulation in an amount sufficient to reduce the pH of the liquid aerosol formulation to a pH ranging from about 4 to about 8, more preferably about 5 to about 7 or about 5.5 to about 6.5. Moreover, the acid is preferably condensable at ambient temperature.

Suitable acids for use in the liquid aerosol formulation include, without limitation, succinic acid, tartaric acid, sulfuric acid, carbonic acid, malonic acid, tartronic acid, levulinic acid, acetic acid, benzoic acid, adipic acid, gluaric acid, pimelic acid and combinations thereof. Preferably, the acid is included in an amount ranging from about 0.1% by weight to about 15% by weight (e.g., about 1% to about 12%, about 2% to about 10%, about 3% to about 9% or about 4% to about 8%).

The amount of acid added to the liquid aerosol formulation may depend on the strength of the acid and the amount needed to adjust the pH of the liquid aerosol formulation to the desired range. If too much acid is added, essentially all of the available nicotine will be protonated and will enter the particulate phase of the aerosol, leaving very little unprotonated nicotine in the gas phase of the aerosol. The resultant aerosol may not produce sufficient levels of sensory response in terms of throat harshness to meet preferences of the more usual smoker of lit-end cigarettes. In contrast, if too little acid is added, a larger amount of nicotine will remain unprotonated and in the gas phase of the aerosol, such that the smoker will experience increased throat harshness. With liquid aerosol formulations of nicotine content above approximately 2% by weight, and in the absence of addition of an acid according to the teachings herein, perceived throat harshness may approach levels which render the aerosol as unpleasant to inhale, and with liquid formulations of nicotine content above approximately 4% by weight, and in the absence of an acid according to the teachings herein, perceived throat harshness may approach levels rendering the aerosol uninhalable. With the addition of an acid according to the teachings herein, perceived throat harshness is maintained at desirable levels, akin to that experienced with lit-end cigarettes.

Preferably, the liquid aerosol formulation also includes at least one nicotine source. The nicotine is included in the liquid aerosol formulation in an amount ranging from about 1% by weight to about 10% by weight (e.g., about 2% to about 9%, about 2% to about 8%, about 2% to about 6%).

In one embodiment, the nicotine source can comprise molecular (unprotonated) nicotine. Typically, molecular nicotine in an aqueous solution has a pH of about 9 to about 10. Thus, the acid would need to be added in an amount sufficient to reduce the pH to about 4 to about 8. In an embodiment, molecular (unprotonated) nicotine is added in liquid form.

In an alternative embodiment, the nicotine source can comprise one or more nicotine salts, which can be added to a formulation to provide both the nicotine and the acid. The nicotine salt can be a salt of succinic acid, tartaric acid, sulfuric acid, carbonic acid, malonic acid, tartronic acid, levulinic acid, acetic acid, benzoic acid, adipic acid, gluaric acid, pimelic acid and combinations thereof. A preferred nicotine-acid salt is nicotine bitartrate.

When vaporized in the electronic smoking article, the liquid aerosol formulation is capable of forming an aerosol having a particulate phase and a gas phase. Preferably, the particulate phase contains protonated nicotine and the gas phase contains unprotonated nicotine. Also preferably, the majority of nicotine is protonated and in the particulate phase, while a minority amount of nicotine is contained in the gas phase. Once the liquid aerosol formulation has been vaporized, the vapor condenses, nicotine is protonated and particles including the protonated nicotine are formed. A minor amount of the nicotine remains unprotonated and stays in the gas phase of the newly generated aerosol. Preferably, because of the addition the acid, about 0.1 to about 1.0% of the total nicotine content of the aerosol is believed to be unprotonated (e.g., about 0.2% to about 0.7% or about 0.3% to about 0.5%), while the remainder of the available nicotine is believed to be delivered in a protonated (charged) form and in the particulate phase. Preferably, the particulate phase includes particles ranging in size from about 0.2 micron to about 2 microns.

Not wishing to be bound by theory, it is believed that the addition of an acid having the desired range of melting point and/or boiling point as taught herein allows the acid to initially enter the initial, not fully developed aerosol-vapor system when the liquid is vaporized by the heater of an electronic smoking article. The acid survives the heating, and remains available to protonate nicotine so that most, if not almost all, of the nicotine remains and/or enters the particulate phase as the aerosol develops. As with an aerosol produced by a lit end cigarette, the initial gas phase nicotine content of the electronically produced aerosol is quite low, preferably in the range of about 0.1 to 1.0% by weight of the total nicotine content of the aerosol, more preferably in the range of about 0.1 to 0.5% by weight of the total nicotine content of the aerosol. Additionally, the nicotine residing in the particulate phase is predominantly protonated and therefore charged and mostly unavailable for transfer into the gas phase of the aerosol.

Furthermore, the acid may be selected and its concentration may be set sufficient to maintain the aforementioned, desired low levels of gas phase nicotine, even at the more elevated nicotine content levels in the liquid formulation. Adult smokers of lit end cigarettes have reported that they, when smoking the more usual, commercially available, electronic smoking articles, did not experience the perceived warmth in the chest that they expect from inhaling cigarette smoke. These prior electronic smoking articles tended to have e-liquid formulations with low levels of nicotine content, generally about 2% or less. To the adult cigarette smoker, these prior electronic smoking articles lacked an important, pleasurable sensory response of a cigarette smoking experience—perceived warmth in the chest. However, prior electronic smoking articles having e-liquid formulations with higher levels of nicotine content, above about 2%, but generally about 3% or 4% by weight, tended to provide more of the desired perceived warmth in the chest, but heretofore, the aerosols produced unacceptably high levels of perceived harshness in the throat. Upon investigation, it has been found that the gas phase nicotine content of the aerosols constituted about 3 to 4% of the total nicotine content of the aerosols.

By preparing a liquid formulation comprising nicotine levels greater than 2% or more by weight, more preferably in range of 2% to about 6% by weight, together with an addition of an acid to the liquid formulation in accordance with the teachings herein, the perceived sensory benefits associated with the higher nicotine levels is achieved (warmth in the chest), while also avoiding the sensory deficits previously associated with higher nicotine levels (excessive harshness in the throat), thereby providing adult cigarette smokers an electronic smoking article that provides a sensorialy pleasant smoking experience, including a low to moderate harshness response in the throat and a perceived warmth in the chest.

With the improved liquid formulation, much of the nicotine in the particulate phase is protonated by the presence of the acid, and any nicotine that is removed from the gas phase by absorption in the throat is not readily replaced by nicotine from the particulate phase. Instead, the protonated nicotine remains in the particulate phase and is not allowed to elevate the harshness response to unacceptable levels. An aerosol produced according to the teachings herein provides enjoyable sensations from low to mild harshness, generally within the expectations of smokers of lit end cigarettes, even with liquid formulations of elevated nicotine content.

In terms of smoking enjoyment, enjoyable sensations are experienced at low to mild levels of throat harshness whereas unenjoyable and potentially unpleasant sensations are perceived at high to extreme levels of throat harshness.

Figure 5:
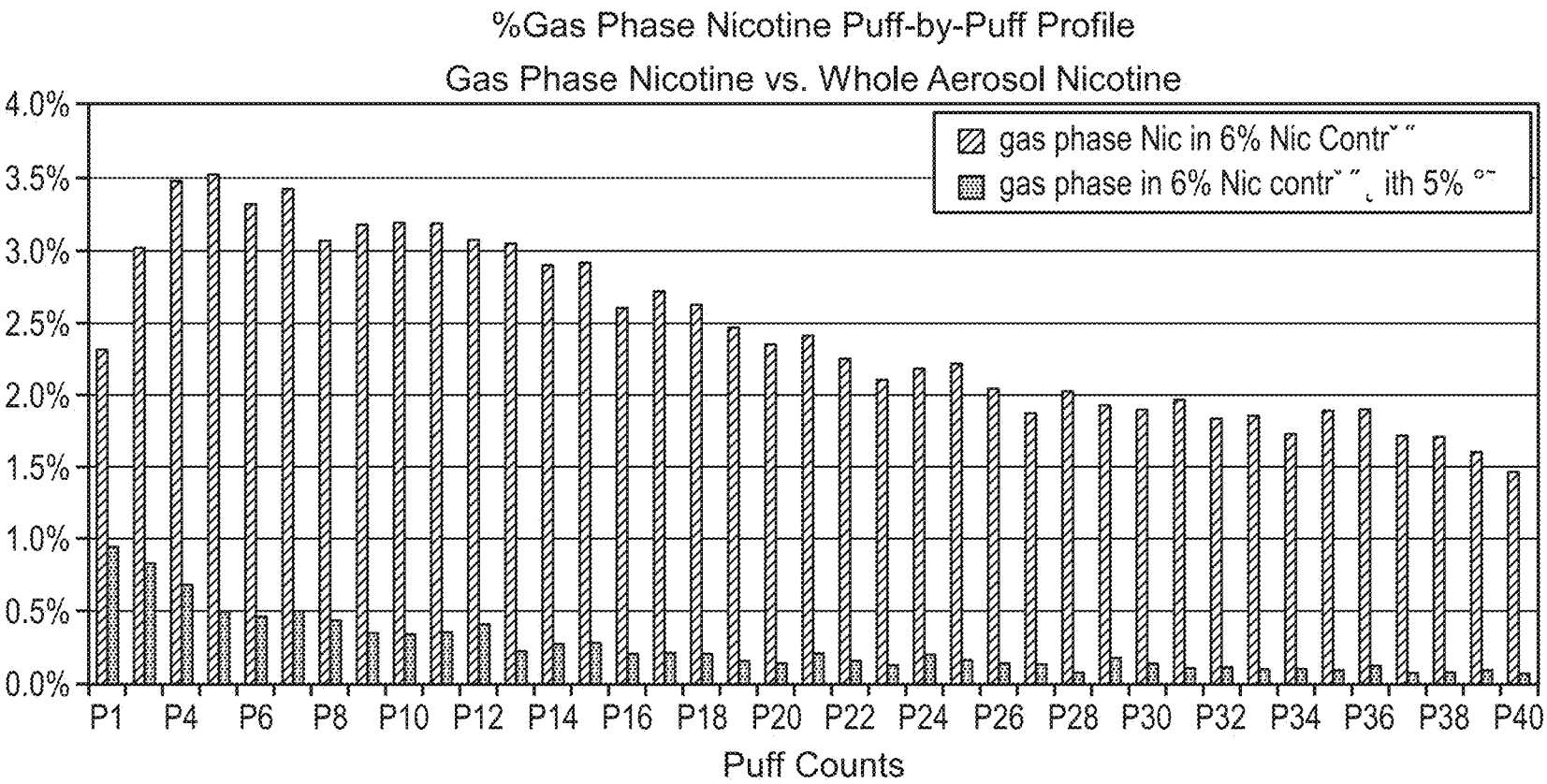
FIG. 5 is a graphical representation showing the gas phase nicotine content per puff of an electronic smoking article including a liquid aerosol formulation not including at least one acid as compared to the gas phase nicotine content per puff of an electronic smoking article including a liquid aerosol formulation including at least one acid as described herein.

To determine the amount of nicotine in the gas phase per puff, a test electronic smoking article including a liquid aerosol formulation as described herein was compared to a control electronic smoking article with a liquid aerosol formulation not including an acid using a gas chromatography/mass spectrometer (GC/MS). The control electronic smoking article formed an aerosol using a liquid aerosol formulation including 6% nicotine and 94% of a 4:1 mixture of glycerin and water, and no acid. The test electronic smoking article formed an aerosol using a liquid aerosol formulation including 6% nicotine, 89% of a 4:1 mixture of glycerin to water, and 5% levulinic acid. Each electronic smoking article was tested over 49 puffs. To determine the nicotine content in the gas phase, the gas vapor was collected behind a Cambridge pad. The results of the test are shown in FIG. 5. As shown, the test electronic smoking article provided less nicotine per puff in the gas phase as compared to the control electronic smoking article.

Unexpectedly, as shown in FIG. 5, the addition of an acid to the liquid aerosol formulation reduces gas phase nicotine. While not wishing to be bound by theory, it is believed that adding an acid to the liquid aerosol formulation to form a liquid aerosol formulation having a pH ranging from about 4 to about 8 results in an aerosol containing a majority amount of protonated nicotine in the particulate phase and a minority amount of unprotonated nicotine, which is maintained in the gas phase of the aerosol.

Advantageously, the addition of tartaric acid (and/or nicotine salt thereof) reduces throat harshness during both inhalation and exhalation. It has been found that use of tartaric acid (and/or nicotine salt thereof), according to the teachings herein, provides little to no harshness to the throat upon exhalation, which is a desirable attribute in terms of sensory response.

In one embodiment, the liquid aerosol formulation can also include ammonia or ammonia compounds in an amount sufficient to further reduce the pH of the liquid aerosol formulation by about 1 to 2 pH units. The addition of ammonia or ammonia compounds may prevent or reduce the formation of char at the heater without affecting the harshness in the throat or warmth in the chest.

When the word "about" is used in this specification in connection with a numerical value, it is intended that the associated numerical value include a tolerance of ±10% around the stated numerical value. Moreover, when reference is made to percentages in this specification, it is intended that those percentages are based on weight, i.e., weight percentages. The expression "up to" includes amounts of zero to the expressed upper limit and all values therebetween. When ranges are specified, the range includes all values therebetween such as increments of 0.1%.

Moreover, when the words "generally" and "substantially" are used in connection with geometric shapes, it is intended that precision of the geometric shape is not required but that latitude for the shape is within the scope of the disclosure. Although the tubular elements of the embodiments are preferably cylindrical, other tubular cross-sectional forms are contemplated, such as square, rectangular, oval, triangular and others. When used with geometric terms, the words "generally" and "substantially" are intended to encompass not only features which meet the strict definitions but also features which fairly approximate the strict definitions.

It will now be apparent that a new, improved, and non-obvious electronic smoking article, liquid aerosol formulation and method has been described in this specification with sufficient particularity as to be understood by one of ordinary skill in the art. Moreover, it will be apparent to those skilled in the art that numerous modifications, variations, substitutions, and equivalents exist for features of the electronic smoking article, liquid aerosol formulation and method which do not materially depart from the spirit and scope of the invention. Accordingly, it is expressly intended that all such modifications, variations, substitutions, and equivalents which fall within the spirit and scope of the invention as defined by the appended claims shall be embraced by the appended claims.

We claim:

1. A cartridge for an electronic vaping device, the cartridge comprising:

a housing;

a liquid formulation in the housing, the liquid formulation including an aerosol former, water, nicotine bitartrate, and an acid, the nicotine bitartrate being provided in an amount sufficient to establish a nicotine content in a range of 2% to 10% by weight based on a weight of the liquid formulation, the acid being condensable at ambient temperature, the acid having a boiling point of at least 150° C., the acid being included in an amount ranging from about 0.1% by weight to about 15% by weight based on the weight of the liquid formulation, the acid including one of succinic acid, tartaric acid, sulfuric acid, carbonic acid, malonic acid, tartronic acid, acetic acid, benzoic acid, adipic acid, gluaric acid, pimelic acid, a sub-combination thereof, or a combination thereof, the liquid formulation having a pH ranging from about 4 to about 8, the liquid formulation being a mixture containing the aerosol former, the water, the nicotine bitartrate, and the acid; and a reservoir in the housing, the reservoir containing the mixture of the liquid formulation.

2. The cartridge of claim 1, wherein the liquid formulation, when heated, forms an aerosol having a particulate phase and a gas phase, the particulate phase contains protonated nicotine, the gas phase contains unprotonated nicotine, and a gas phase nicotine content of the aerosol is equal to or less than about 1% of a total nicotine content of the aerosol.

3. The cartridge of claim 1, wherein the aerosol former includes one of propylene glycol, glycerin, a sub-combination thereof, or a combination thereof.

4. The cartridge of claim 3, wherein the aerosol former is included in an amount ranging from about 40% by weight to about 90% by weight, based on a weight of the mixture of the liquid formulation in the reservoir.

5. The cartridge of claim 3, wherein the liquid formulation comprises glycerin and propylene glycol in a ratio of about 2:3 or greater.

6. The cartridge of claim 1, further comprising:

a heater in the housing; and wherein the reservoir includes a valve at an outlet of the reservoir, and the heater is operable to volatilize the liquid formulation and form an aerosol.

7. The cartridge of claim 6, further comprising:

a wick in the housing; and the heater is a coil heater in communication with the wick, and the wick is configured to draws the liquid formulation from the reservoir via capillary action.

8. A cartridge for an electronic vaping device, the cartridge comprising:

a housing; and a liquid formulation in the housing, the liquid formulation including a vapor former, water, a nicotine salt, and benzoic acid, the liquid formulation including the nicotine salt in an amount sufficient to establish a nicotine content in a range of 2% to 10% by weight based on a weight of the liquid formulation, the liquid formulation including benzoic acid in an amount ranging from about 2.0% to about 8.0% by weight, and the liquid formulation being a mixture containing the vapor former, the water, the nicotine salt, and the benzoic acid.

9. The cartridge of claim 8, wherein the liquid formulation, when heated, forms an aerosol having a particulate phase and a gas phase, the particulate phase contains protonated nicotine, the gas phase contains unprotonated nicotine, and a gas phase nicotine content of the aerosol is equal to or less than about 1% of a total nicotine content of the aerosol.

10. The cartridge of claim 8, wherein the amount of the nicotine salt is about 2% to about 6% by weight, the liquid formulation has a pH ranging from about 4 to about 8.

11. The cartridge of claim 8, wherein the vapor former includes glycerin and propylene glycol.

12. The cartridge of claim 11, wherein the nicotine salt includes nicotine bitartrate.

13. The cartridge of claim 11, wherein the vapor former includes the glycerin and the propylene glycol in a ratio of about 2:3 (glycerin:propylene glycol).

14. The cartridge of claim 8, wherein the nicotine salt includes nicotine bitartrate.

15. An electronic vaping device, comprising:

the cartridge of claim 8.

* * * * *